United States Patent [19]

Siebeneichen

[11] 4,311,112

[45] Jan. 19, 1982

[54] INSTALLATION FOR APPLYING A LAYER OF A CORROSION-INHIBITING MATERIAL

[75] Inventor: Kurt Siebeneichen, Wolfsburg, Fed. Rep. of Germany

[73] Assignee: Volkswagenwerk Aktiengesellschaft, Wolfsburg, Fed. Rep. of Germany

[21] Appl. No.: 165,107

[22] Filed: Jul. 1, 1980

[30] Foreign Application Priority Data

Jul. 4, 1979 [DE] Fed. Rep. of Germany ..... 2926949

[51] Int. Cl.[3] ..... B05C 7/04

[52] U.S. Cl. ..... 118/408; 118/317

[58] Field of Search ..... 118/317, 468, 421, 429; 134/123, 166 R, 167 R, 168 R

[56] References Cited

U.S. PATENT DOCUMENTS 1,172,790 2/1916 Griffith ..... 118/317

3,916,924 11/1975 McGowan ..... 134/168 R X

FOREIGN PATENT DOCUMENTS 2755947 6/1979 Fed. Rep. of Germany .

*Primary Examiner*—John P. McIntosh

*Attorney, Agent, or Firm*—Spencer & Kaye

[57] ABSTRACT

In apparatus for applying, by flood coating, a layer of a corrosion-inhibiting material to internal surface regions of cavities in a metal structure via passages communicating with the cavities, which apparatus includes at least one conduit having an outlet end arranged to communicate with one such passage for feeding corrosion-inhibiting material through that passage and into a cavity communicating therewith, the conduit is constituted in the region of its outlet end, by a main conduit portion extending upwardly at an angle to the vertical and arranged to convey material from a supply tank, and a pipe section which is open at both ends and is oriented with its longitudinal axis substantially vertical, the main conduit portion being connected to the pipe section at a point intermediate its ends for conveying material in an upward direction into the pipe section, the upper end of the pipe section constituting the outlet end of the conduit, and the lower end of the pipe section constituting a drain opening via which excess corrosion-inhibiting material can flow from the associated cavity into an underlying collecting trough.

3 Claims, 2 Drawing Figures

INSTALLATION FOR APPLYING A LAYER OF A CORROSION-INHIBITING MATERIAL

BACKGROUND OF THE INVENTION

The present invention relates to an installation for applying a layer of a corrosion-inhibiting material to internal surface regions of cavities in a metal structure, such as a car body, by flood coating.

In FRG AS No. 27 55 947 of Apr. 24, 1980, there is described an installation for applying a layer of a waxy, corrosion-inhibiting material by flood coating. This installation offers the advantage, as compared to other processes and installations such as the dip coating process, that only the desired surface zones of the cavities are supplied with the material directly and in an excess. In contrast to conventional spray nozzles, this supply takes place without a preferential direction of the movement of material, whereby, as is known, shading effects are evoked which lead precisely at critical locations to a deficient application of material.

In the installation previously proposed, for example, an automobile body is placed on vertically supported zones of the free ends of conduits in such a way that openings in the cavities to be coated are in alignment with the free ends of the conduits. Flood coating consists in filling the cavities through these conduits with the waxy material. The excess material must then be allowed to drain away. This must be done quickly because, among other reasons, there could be the danger of solidification of also the excess waxy material due to cooling of the body. Drainage must be effected through the openings in the cavities in alignment with the free ends of the conduits.

Conceivably, for a rapid evacuation of these openings in the cavities, the zones of the free ends of the feed conduits for the material could be mounted to be retractable or pivotable. However, this results in additional expenditure, not only with respect to the mechanical fastening of these end zones, but also with respect to control, since this movement of the end zones of the conduits must understandably be carried out in synchronism with other procedures during the treatment, for example in proper time sequence with the turning on and turning off of the conveying means for the waxy material or with the activation of a transport mechanism for the article provided with the cavities, i.e. in the present example the automobile body.

SUMMARY OF THE INVENTION

It is an object of the invention to construct such an installation in a manner to avoid the need for incurring such an additional expenditure in order to be able to change over from supplying the cavities with the material through the aforementioned openings to draining excess material from the cavities by way of these openings.

This and other objects are achieved, according to the invention, in apparatus for applying, by flood coating, a layer of a corrosion-inhibiting material to internal surface regions of cavities in a metal structure via passages communicating with the cavities, which apparatus includes at least one conduit having an outlet end arranged to communicate with one such passage for feeding corrosion-inhibiting material through that passage and into a cavity communicating therewith, the conduit extending substantially vertically in the region of its outlet end, a heated collecting trough positioned below the conduit for collecting material which drains out of the cavities, a heated storage tank connected to the conduit to supply material thereto, and a conveying device for conveying material from the tank into the conduit, by constituting the conduit, in the region of its outlet end, of a main conduit portion extending upwardly at an angle to the vertical and arranged to convey material from the tank, and a pipe section which is open at both ends and is oriented with its longitudinal axis substantially vertical, the main conduit portion being connected to the pipe section at a point intermediate its ends for conveying material in an upward direction into the pipe section, the upper end of the pipe section constituting the outlet end of the conduit, and the lower end of the pipe section constituting a drain opening via which excess corrosion-inhibiting material can flow from the associated cavity into the trough.

A substantial advantage of an installation according to this invention is that it eliminates the need for separate heating devices in the zones of the free end of the conduit. Also, there is no need for valves along the course of the conduit provided in addition to the conveying device, which latter can be turned on and off.

It has proven to be expedient to maintain a joining angle of between 20° and 50° between each pipe and its associated conduit. It is then ensured that any outflow of excess protective material from the respective cavity is prevented solely by the pressure of the entering material when the conveying device is turned on, whereas, after the conveying device has been turned off, drainage of excess material takes place immediately via the respective opening in the cavity and the downwardly open pipe.

DESCRIPTION OF THE PREFERRED EMBODIMENTS

Figure 1:
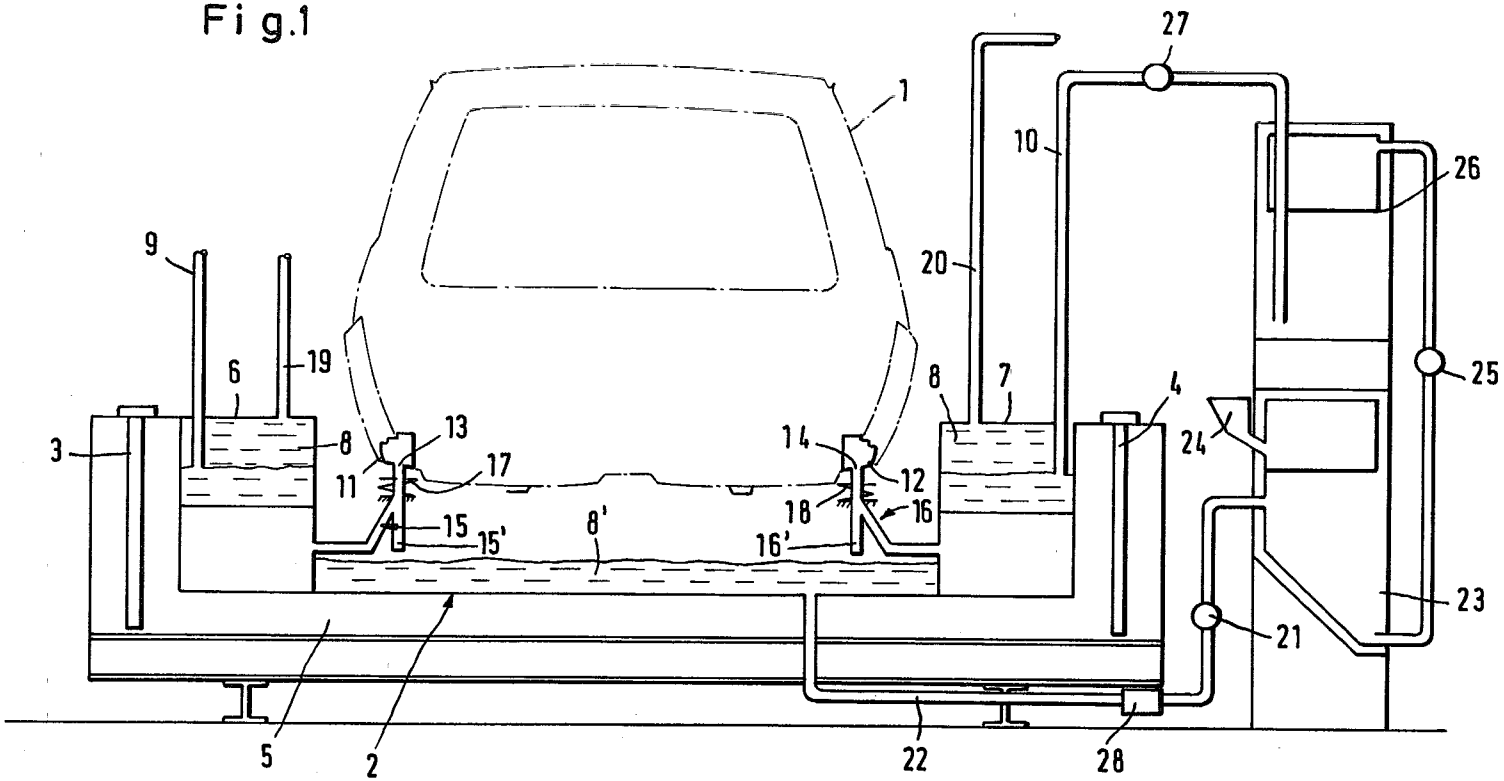
FIG. 1 is a simplified elevational view of an installation constructed according to a preferred embodiment of the invention.

FIG. 1 shows a flood coating installation which includes a heated collecting trough 2 arranged underneath the body 1 to be treated, which latter is suspended on a conveyor belt, not shown, and is transported in a direction at right angles to the plane of the drawing. Heating of the trough is effected in this embodiment by means of electric resistance heating rods 3 and 4 projecting into an oil space 5 surrounding the actual collecting trough laterally and on the bottom.

Laterally of the lower zone of the body 1, which latter is moved into the illustrated treatment position by being lowered, two storage tanks 6 and 7, in this embodiment, are provided for holding corrosion-inhibiting material 8 to be applied to hidden surface regions of the body 1. By way of example, this material is wax. The heating unit, constituted by the heat-carrying medium 5, for example water or oil, and the heating rods 3 and 4, is constructed so that is simultaneously heats the material 8 to a temperature at which this material, solid at room temperatures, is in the liquid state. However, this does not exclude the possibility that the wax is fed already in the liquid state through feed conduits 9 and 10 and is maintained in the molten condition in the storage tanks 6 and 7 by means of a corresponding heat supply.

In the embodiment of FIG. 1, it is assumed that it is intended to cover the internal surfaces of side rails 11 and 12 of the vehicle with a wax layer with the aid of the installation. Downwardly pointing holes are arranged in the side rails 11 and 12 for inflow of the wax, which holes are either present for other reasons or can be produced by additional operating steps. After the body 1 has been lowered as mentioned above, these holes 13 and 14 are in alignment with the free ends of conduits 15 and 16 which emanate from the storage tanks 6 and 7 and are resiliently supported by springs 17 and 18, respectively, which absorb the bearing force imposed by the lowered body 1. In this embodiment, the conduits 15 and 16 can thus be fashioned to be rigid, i.e. as pipes.

The storage tanks 6 and 7 are associated in this embodiment with conveying devices for the wax 8, constituted by compressed-air lines 19 and 20 which raise, in a conventional manner, the pressure in the region above the wax 8 in the storage tanks 6 and 7 and thereby force wax into the hollow rails 11 and 12 to be protected.

The coating of the internal surfaces of the rails 11 and 12 takes place by flooding, i.e. with an excess of wax. Thereby difficulties with respect to the wetting and/or coating of the surface regions, covered by ribs or the like, are avoided, as could occur in case of a directional spray coating method. The excess material drips or flows off through leakage spots in the hollow rails 11 and 12, which spots are always present or are additionally provided, primarily in a manner still to be described below, after shutting off of the conveying device, through the downwardly open pipes 15′ and 16′ of conduits 15 and 16 in the downward direction into the heated collecting trough 2 and is collected therein at 8′.

The thus-collected material 8′ passes, under the action of a pump 21, through a drainage conduit 22 into a processing device 23 provided with a filling hopper 24 for solid wax material to make up losses occurring during operation and from there via a pump 25 into a reservoir 26 from which the liquid wax is fed by means of pump 27 and via conduits 9 and 10 to the storage tanks 6 and 7. Thus, in this embodiment the melting of the wax takes place in the processing device 23, and all subsequent components of the installation are supplied with such an amount of heat that the wax is maintained in the molten state.

Of course, a filter for the recycled wax will be inserted at a suitable location, for example at 28.

Figure 2:
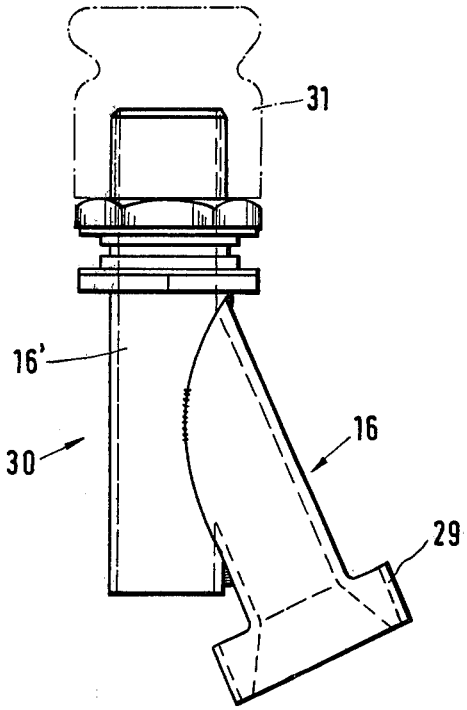
FIG. 2 is an elevational, detail view of the construction of the open end zone of a conduit according to the invention.

FIG. 2 shows the free end zone of a preferred embodiment of the conduit 16 and pipe 16′ to an enlarged scale, the corresponding end zone of conduit 15 being of identical structure.

As is shown, the pipe 16′ is oriented substantially vertically and is open at its upper and lower ends. The main portion of conduit 16 terminates in this pipe and is oriented at an angle of about 30° thereto. The main portion can be composed in this embodiment of several individual parts, as indicated by the presence of flange 29. Thus, the arrangement illustrated in FIG. 2 forms a branch 30.

By properly selecting the joining angle of the main portion of conduit 16 with the pipe 16′ which is open at both ends, it is ensured that when the conveying devices constituted by the compressed-air feed lines 19 and 20 are operative the thus-conveyed, waxy material is propelled obliquely upwardly into the vertical pipes 15′ and 16′ so as to flow only in the upward direction and drainage of material already present in the respective cavity of the body through the respective pipe 15′ or 16′ is prevented. As noted above herein, these results are achieved for joining angle values between 20° and 50°.

On the other hand, this exceedingly simple structure ensures that, after the conveying devices have been turned off, the openings in the cavities in alignment with the respective pipe 15′ or 16′ are utilized for the drainage of excess material through the substantially vertically extending pipes 15′ and 16′. Thereby, not only is it unnecessary to arrange for a mounting of the free ends of conduits 15 and 16 so that they can be pivoted away, but there is no need for an additional heating of the ends of these conduits, either.

In the illustrated embodiment, the pipes 15′ and 16′ are provided with a rubber seal, as indicated in FIG. 2 by seal 31 on pipe 16′, for producing a sealed path between each pipe and its associated body cavity.

Not shown in FIG. 2 is spring 18 (see FIG. 1) which supports the outlet end of conduit 16 and presses it against hollow rail 12 when body 1 is lowered.

It will be understood that the above description of the present invention is susceptible to various modifications, changes and adaptations, and the same are intended to be comprehended within the meaning and range of equivalents of the appended claims.

What is claimed is:

1. In apparatus for applying, by flood coating, a layer of a corrosion-inhibiting material to internal surface regions of cavities in a metal structure via passages communicating with the cavities, which apparatus includes at least one conduit having an outlet end arranged to communicate with one such passage for feeding corrosion-inhibiting material through that passage and into a cavity communicating therewith, the conduit extending substantially vertically in the region of its outlet end, a heated collecting trough positioned below the conduit for collecting material which drains out of the cavities, a heated storage tank connected to the conduit to supply material thereto, and a conveying device for conveying material from the tank into the conduit, the improvement wherein said conduit comprises, in the region of its outlet end, a main conduit portion extending upwardly at an angle to the vertical and arranged to convey material from said tank, and a pipe section which is open at both ends and is oriented with its longitudinal axis substantially vertical, said main conduit portion being connected to said pipe section at a point intermediate the ends of said pipe section for conveying material in an upward direction into said pipe section, the upper end of said pipe section constituting the outlet end of said conduit, and the lower end of said pipe section constituting a drain opening via which excess corrosion-inhibiting material can flow from the associated cavity into said collecting trough.

2. An arrangement as defined in claim 1 wherein the region of the outlet end of said conduit is free of heating devices.

3. An arrangement as defined in claim 1 wherein the longitudinal axis of said main conduit portion extends at an angle of 20° to 50° to the longitudinal axis of said pipe section.

* * * * *